United States Patent [19]

Little

[11] 4,091,502

[45] May 30, 1978

[54] COUNTERBALANCE MECHANISM

[75] Inventor: Carl H. Little, Jamestown, N.Y.

[73] Assignee: Weber-Knapp Company, Jamestown, N.Y.

[21] Appl. No.: 740,430

[22] Filed: Nov. 10, 1976

[51] Int. Cl.[2] ..... E05F 1/12; E05F 5/14

[52] U.S. Cl. ..... 16/190; 16/85; 16/145; 16/180

[58] Field of Search ..... 16/190, 180, 1 C, 85, 16/141, 142, 144, 145; 49/386; 217/60 R

[56] References Cited

U.S. PATENT DOCUMENTS

| | | | |
|---|---|---|---|
| 3,414,933 | 12/1968 | Gronbach | 16/180 |
| 3,496,595 | 2/1970 | Larson | 16/190 X |
| 3,714,680 | 2/1973 | Little | 49/386 X |
| 3,766,600 | 10/1973 | Little | 16/190 |
| 3,906,587 | 9/1975 | Little | 16/190 |

FOREIGN PATENT DOCUMENTS

| | | | |
|---|---|---|---|
| 674,781 | 5/1966 | Belgium | 16/180 |

*Primary Examiner*—James Kee Chi

*Attorney, Agent, or Firm*—Bean, Kauffman & Bean

[57] ABSTRACT

A counterbalance mechanism including a cabinet mounted stationary hinge part; a movable hinge part pivotally mounted on the stationary hinge part and connected for conjunctive vertical swinging movement with a cabinet lid; and a counterbalance assembly including an adjustable compression spring arranged to bear adjacent its opposite ends on the hinge parts characterized in that the counterbalance assembly is constrained from swinging movements relative to the lid connected hinge part whereby to minimize mechanism installation space requirements.

2 Claims, 6 Drawing Figures

Fig. 3.
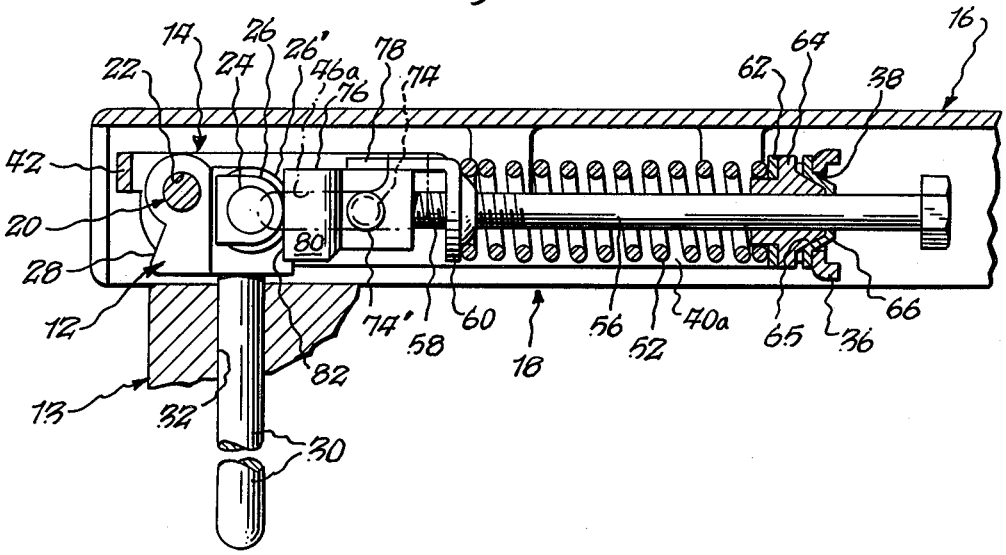
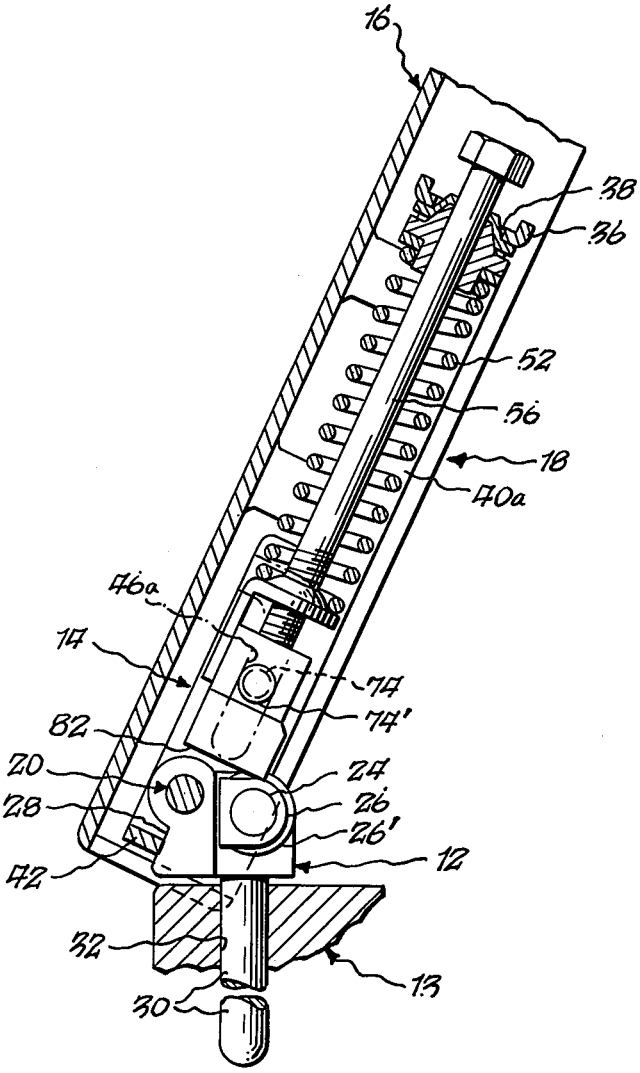
Fig. 3a.

COUNTERBALANCE MECHANISM

BACKGROUND OF THE INVENTION

In commonly assigned U.S. Pat. No. 3,766,600, there is disclosed a mechanism for counterbalancing the torque effects of gravity on vertically swinging cabinet lids, which includes a stationary hinge part adapted to be fixed to a cabinet, a movable hinge part mounted on the stationary hinge part for pivotal movement about an essentially horizontally disposed first axis; and a counterbalance assembly including an adjustable compression spring arranged to bear adjacent its opposite ends on the hinge parts for establishing a moment tending to counterbalance gravity induced torque effects on a cabinet lid during vertical swinging movements thereof. More specifically, the assembly includes a connector having a bore opening; a hinge pin for supporting the connector on the stationary hinge part for relative movement about an axis disposed essentially normal to the bore opening and parallel to the first axis; a friction brake member carried for vertical tilting movements relative to the movable hinge part; a bolt having one end extending freely through the friction brake member and having another end rotatably supported within the bore opening; and a plate threadably carried by the bolt adjacent the connector, whereby to permit adjustments of the plate lengthwise of the bolt. The spring is in the form of a coil type compression spring arranged essentially concentrically of the bolt to bear adjacent its opposite ends on the plate and friction brake member, such that displacements of the plate lengthwise of the bolt effect the degree to which the spring is compressed.

The mechanism disclosed in U.S. Pat. No. 3,766,600 is believed to have the singular drawback of requiring swinging movements of the counterbalance assembly relative to the lid affixed hinge part, such that use of the mechanism is prevented in certain installations having limited space allowances.

SUMMARY OF THE INVENTION

The present invention is directed towards improvements in counterbalance mechanisms of the general type disclosed in U.S. Pat. No. 3,766,600, which serve to minimize mechanism installation space requirements.

In the counterbalance mechanism of the present invention, the counterbalance assembly is characterized in that a connector is constrained for reciprocating movements in a direction essentially aligned with the axis of a bolt and arranged for camming engagement with the cabinet affixed hinge part. By means of the present construction, swinging movements of the counterbalance assembly relative to the lid affixed hinge part are effectively constrained, whereby to minimize mechanism installation space requirements.

DRAWINGS

Figure 2:
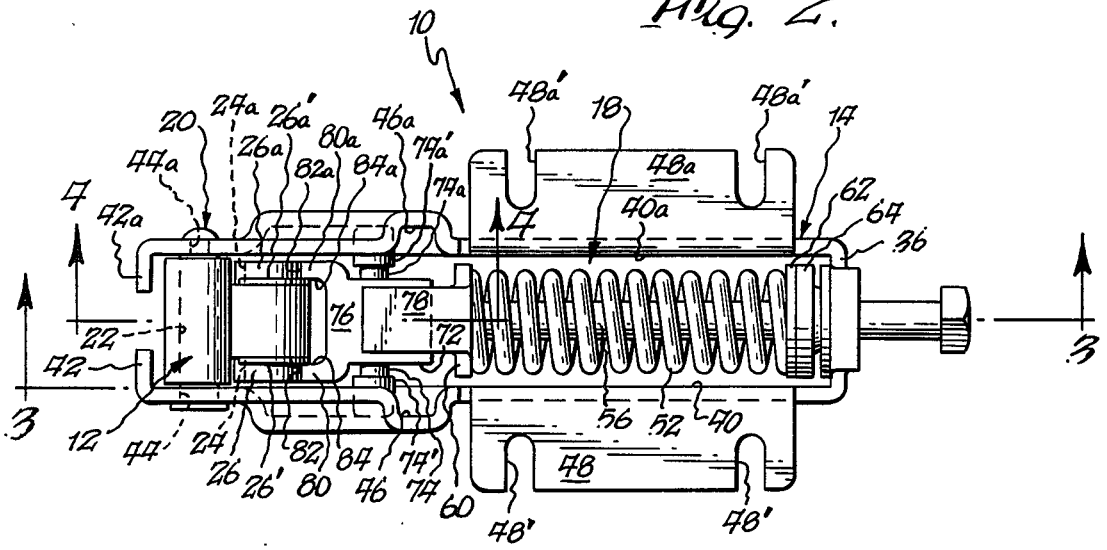
FIG. 2 is a top plan view thereof.
Figure 4:
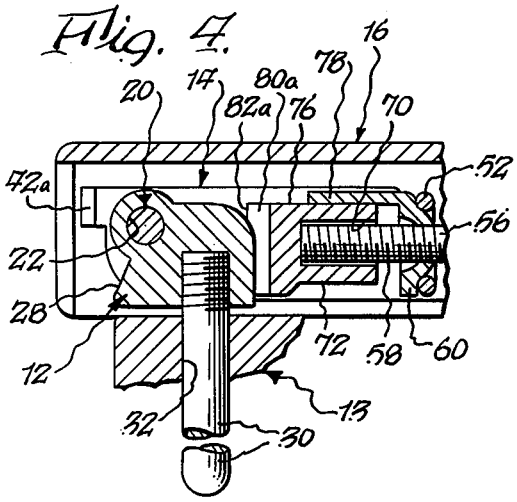
Figure 4A:
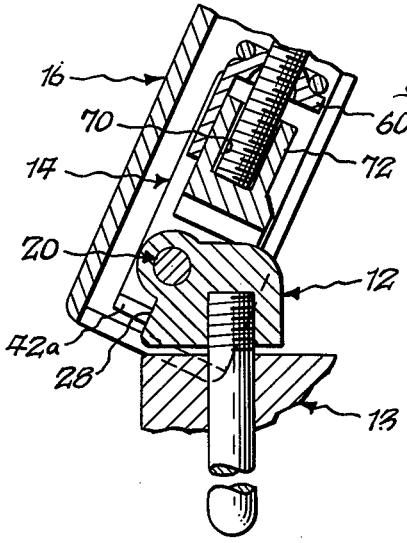

FIGS. 3 and 3*a* are sectional views taken generally along the line 3—3 in FIG. 2, and showing the mechanism in lid closed and lid open positions, respectively; and FIGS. 4 and 4*a* are sectional views taken generally along the line 4—4 in FIG. 2, and showing the mechanism in lid closed and lid open positions, respectively.

DETAILED DESCRIPTION

Figure 1:
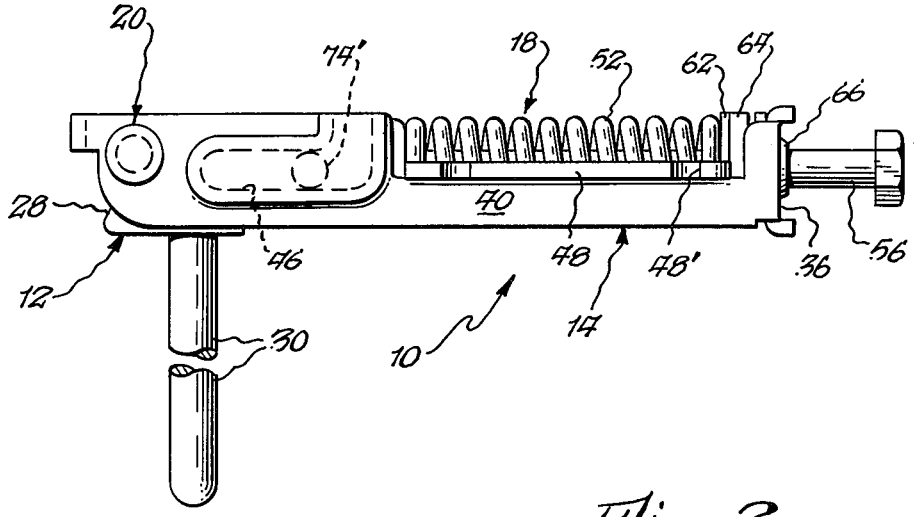
FIG. 1 is a side elevational view of a counterbalance mechanism formed in accordance with the present invention.

Reference is now made particularly to FIGS. 1 and 2, wherein the counterbalance mechanism of the present invention is generally designated as 10. Mechanism 10 includes a stationary or cabinet hinge part 12, which is adapted to be fixed to a cabinet, shown in part at 13 in FIGS. 3–4*a;* a movable hinge part 14 for supporting a cabinet opening covering lid 16; a counterbalance assembly 18; and a hinge pin 20 for supporting hinge part 14 on hinge part 12, whereby lid 16 is supported for vertical swinging movements from a lid closed position in which the lid is normally horizontally disposed into a lid opened position in which the lid extends vertically at some given angle relative to the horizontal. For any given installation, one or more of mechanisms 10 may be employed, depending on the weight and/or dimensions of lid 16.

As will be apparent from viewing FIGS. 2 and 3, stationary hinge part 12 is formed with bearing opening 22 for receiving hinge pin 20 and a pair of integrally formed cam elements 24, 24*a*, which are preferably covered with friction reducing plastic sleeves 26, 26*a* formed with rim portions 26', 26*a'*. The axes of cam elements 24, 24*a* are disposed in a parallel, offset relationship relative to the axis of hinge pin 20. Moreover, the rearwardly facing surface of hinge part 12 is shown as being formed with a planar stop or abutment surface 28. While hinge part 12 is also shown as including a mounting pin 30 sized for receipt within a mounting opening 32 formed in cabinet 13, it will be understood that hinge part 12 may be otherwise secured to such cabinet.

Movable hinge part 14 is shown in FIGS. 1–3*a* as being of generally U-shaped configuration including a connecting portion 36, which is formed with a through opening 38; and a pair of leg portions 40, 40*a*. Leg portions 40, 40*a* are formed in succession from adjacent their free ends with aligned and inwardly extending stop flanges 42, 42*a;* aligned bearing openings 44, 44*a* sized to receive opposite ends of hinge pin 20; aligned and inwardly opening generally L-shaped guide slots 46, 46*a;* and aligned and outwardly extending mounting flanges 48, 48*a*. As will be apparent from viewing FIGS. 3*a* and 4*a*, stop flanges 42, 42*a* are positioned for engagement with stop surface 28 of hinge part 12 in order to define the fully open position of mechanism 10 and thus lid 16. While mounting flanges 48, 48*a* are shown as being formed with lid fastener receiving slots 48', 48*a'*, the specific mode of attaching hinge part 14 to lid 16 for conjunctive vertical swinging movement forms no part of the present invention.

In this connection, it will be understood that for installations where the lid is independently supported on the cabinet by a separate hinge, not shown, hinge part 14 may be movably coupled to the lid to provide for conjunctive movements, as is now conventional.

By viewing FIGS. 3–4*a*, it will be seen that the illustrated construction of hinge part 14 provides a relatively compact or thin profile, such as to enable the hinge part to be mounted wholly within a relatively thin lid and be hidden from view by a suitably affixed lid liner panel, not shown.

Assembly 18 is best shown in FIGS. 2, 3 and 4 as including a coil type compression spring 52, which is arranged concentrically of a bolt or rod 56 having a screw threaded end portion 58. Spring 52 is arranged to bear adjacent its opposite ends on an L-shaped spring plate or adjustment nut 60 threaded onto bolt portion 58 and a retainer disc or the like 62; retainer disc 62 in turn bearing on one end of a resiliently deformable, plastic brake shoe 64, which is arranged concentrically of and in frictional engagement with the front end portion of bolt 56. The forwardly facing end of shoe 64 is arranged for engagement with the converging inner or bearing walls 65 of a through bored cup shaped member 66, which is in turn received within connecting portion opening 38 whereby assembly 18 is constrained relative to or mounted on hinge part 14. As will be apparent from viewing FIG. 3, bolt 56 passes freely through member 66 and connecting portion opening 38, and thus is free to reciprocate and undergo rotary adjustment movements relative to hinge part 14.

The specific construction of shoe 64 forms no part of the present invention, such shoe having been previously described for instance in commonly assigned U.S. Pat. No. 3,187,374 and U.S. Pat. No. 3,766,600. It is believed sufficient for the understanding of the present invention to note that the "snubbing" or"friction braking" action of shoe 64 on bolt 56 dampens movement of lid 16, as a function of the variations in the compression of spring 52, which occurs as an incident to changes in the position of lid 16.

Preferably, the rear end portion of bolt 56 is freely rotatably received with a bore opening 70 formed in a connector 72; the latter being mounted or constrained for reciprocating movement in a direction aligned with the axis of bolt 56 by a pair of aligned guide pin elements 74, **74*a* slidably received one within each of the pair of elongated guide slots 46, 46*a*, which are formed with open ends to facilitate assembly of the mechanism. The axes of guide pin elements 74, 74*a* are arranged essentially parallel to hinge pin 20 and to intersect the axis of bore opening 70, and thus the axis of bolt 56, in a right angular relationship, whereas guide slots 46, 46*a* are arranged to extend co-directionally with the axis of such bolt. Preferably, guide pin elements 74, 74*a* are covered with friction reducing plastic caps 74', 74*a*'**.

Connector 72 is also formed with a guide surface 76, which is arranged to extend co-directionally with bore opening 70 for slidable engagement with guide extension 78. This construction is preferred in that it permits rotations of bolt 56 to produce reciprocating movements of plate 60 lengthwise of the bolt for the purpose of adjustably varying the extent to which spring 52 is initially compressed, whereby permitting adjustments of the counterbalancing effect of the mechanism on lid 16. Alternatively, this adjustment feature, which is now conventional, may be dispensed with and bolt 56 simply fixed to connector 72.

Now referring particularly to FIGS. 2, 3 and **3*a*, it will be seen that connector 72 is additionally formed with a pair of parallel flange members 80, 80*a*, which extend co-directionally with bore opening 70 and are spaced apart sufficiently to freely straddle hinge part 12. Further, flange members 80, 80*a* are formed with aligned, free edge or cam follower surfaces 82, 82*a*, which are preferably planar and arranged for bearing surface-to-surface sliding, camming engagement one with each of cylindrical surface portions of cam element sleeves 26, 26*a*. Cam element sleeve rim portions 26', 0 26*a*' are arranged to engage with facing surfaces 84, 84*a*, of flange members 80, 80*a*, respectively, whereby to maintain connector 72 in relative alignment with hinge part 12** and prevent binding therebetween.

It will be understood that spring 52 is normally in a compressed state and establishes a force acting co-directionally with the axis of bolt 56 in order to maintain connector cam follower surfaces 82, **82*a* in bearing surface-to-surface engagement with cam sleeves 26, 26*a* and to produce a lid counterbalancing moment acting in a counter-clockwise direction about hinge pin 20, as viewed in FIGS. 3 and 3*a*. In the illustrated construction, the lid counterbalancing moment established by spring 52** varies with lid opening angle, and is preferably matched as closely as possible, or as is desirable, with the gravity induced moment acting on the lid, such that the weight of the lid is counterbalanced at least in part throughout essentially the whole of its range of vertical swinging movements.

The illustrated mode of movably interconnecting or coupling connector 72 and stationary hinge part 12, as by means of cam follower surfaces 82, **82*a* and cam elements 24, 24*a*, is a particularly important feature of the present invention, since it permits movements of the connector and thus counterbalance assembly 18 relative to movable hinge part 14 to be limited to reciprocating movements occurring wholely within the vertical or "thickness" profile of such hinge part. As a result, movable hinge part 14** may be fitted and concealed within a relatively thin lid.

Preferably, the construction is such that the axis of bolt 56, along which acts the force produced by spring 52, is arranged to intersect the line of surface-to-surface engagement between cam follower surfaces 82, **82*a* and cam element caps 26, 26*a* in order to prevent application of lateral forces to guide pins 74, 74*a* when lid 16 is in its normal closed position shown in FIG. 3. While such line of engagement moves progressively away from the axis of bolt 56, as lid 16 is swung into its open position shown in FIG. 3*a*, the lateral forces to which guide pins 74, 74*a*** are subjected are not excessive, since spring force progressively decreases incident to movement of the lid towards its open position.

The frictional effects occasioned by sliding surface engagement of cam follower surfaces 82, **82*a* with cam element caps 26, 26*a* could be substantially reduced for instance by the expedient of mounting cam elements 24, 24*a* for rotation relative to hinge part 12. However, such frictional effects are normally not objectionable, since they cooperate with the frictional effects occasioned by sliding engagement of guide pin elements 74, 74*a* with the surfaces of hinge part 14 bounding guide slots 46, 46*a* and those produced by brake shoe 64** in serving to retard coasting of the swinging lid.

As is conventional, the "snubbing action ", which is produced by frictional engagement of shoe 64 with bolt 56 always opposes movement of lid 16, and thus alternately acts in opposition to and in conjunction with spring 52 during opening and closing movements of the lid, respectively. Thus, the "snubbing" action cooperates with the spring to define a counterbalance envelope for the lid. When the gravity produced torque curve of lid 16 falls within this envelope, the lid is "balanced" and prevented from coasting towards either of its open or closed positions. However, when for instance a portion of the torque curve of the lid is disposed about its envelope, as is preferred during the last few degrees of lid closing movement, the lid is not "balanced" and gravity is permitted to force same into a tightly closed position.

As indicated above, the moment of spring 52 acting alone would normally be matched as closely as possible with the gravity produced torque curve of the lid, and the "snubbing" action of the brake shoe employed to compensate for any counterbalancing deficiencies in the patterning of the spring moment, as well as to prevent coasting of the lid. However, when the spring moment can be properly matched with the lid torque curve and/or coasting of the lid is not objectionable, the brake shoe may be eliminated.

The present invention has been described with specific reference to the mounting of assembly 18 for non-swinging reciprocating movement on movable hinge part 14 in order to minimize its installation space requirements, eg. the required thickness of lid 16, as viewed for instance in FIG. 3. It will be understood, however, that assembly 18 may be alternatively mounted on stationary hinge part 12 in installations where it is desired to minimize either the "wasted" space between the rear wall of a cabinet and an adjacent building wall or the thickness of such cabinet rear wall.

I claim:

1. A mechanism for use in counterbalancing the weight of a lid supported on a cabinet for vertical swinging movements between closed and open positions, said mechanism comprising:

a stationary hinge part adapted to be fixed to said cabinet;

a movable hinge part;

hinge pin means for pivotally connecting said movable hinge part to said stationary hinge part for vertical swinging movements relative to said cabinet about an essential horizontal hinge axis, said movable hinge part being adapted to be coupled to said lid for conjunctive vertical swinging movements when said movable hinge part is swung about said hinge axis;

one of said hinge parts defining cam means, said cam means including a pair of aligned cam elements having cylindrical surface portions arranged in a parallel offset relationship relative to said hinge axis;

the other of said hinge parts being of generally U-shaped configuration including a connecting portion and a pair of parallel leg portions extending therefrom, said connecting portion having a through opening, said leg portions having aligned openings to receive said hinge pin means;

a connector defining cam follower means, said cam follower means including a pair of parallel flange members arranged to straddle said one of said hinge parts, said flange members defining aligned cam follower surfaces arranged for bearing surface-to-surface sliding engagement one with each of said cylindrical surface portions, said cam follower surfaces being planar;

mounting means for mounting said connector for reciprocating movement relative to said other of said hinge parts, said mounting means including a bolt having one end received for bearing engagement within an opening formed in said connector and an opposite end movably supported within said through opening of said connecting portion and a pair of aligned guide pin elements fixed to said connector and slidably received one within each of a pair of aligned guide slots formed in said leg portions, said guide pin elements being arranged essentially parallel to said hinge axis and to intersect the axis of said bolt, said guide slots extending co-directionally with said axis of said bolt and having open ends for receiving said guide pin elements, said axis of said bolt being arranged to intersect the line of said surface-to-surface engagement when said lid is in said closed position; and spring means arranged to bear adjacent opposite end thereof on said connector and said connecting portion for biasing said cam follower surfaces into surface bearing engagement with said cylindrical surface portions whereby to establish a moment acting about said hinge axis and tending to counterbalance the torque effects of gravity on said lid during said vertical swinging movements thereof.

2. A mechanism according to claim 1, wherein said cam elements are covered with friction reducing plastic sleeves serving to define said cylindrical surface portions, said sleeves being formed with rim portions arranged to engage with facing surfaces of said flange members.

* * * * *